US005249538A

United States Patent [19]

Nakano et al.

[11] Patent Number: 5,249,538

[45] Date of Patent: Oct. 5, 1993

[54] SEWING APPARATUS EQUIPPED WITH AN AUTOMATIC THREAD SUPPLY DEVICE

[75] Inventors: Minoru Nakano; Toru Yamazaki, both of Osaka, Japan

[73] Assignee: Pegasus Sewing Machine Mfg., Co., Ltd., Japan

[21] Appl. No.: 689,509

[22] Filed: Apr. 23, 1991

[30] Foreign Application Priority Data

Apr. 24, 1990 [JP] Japan ..... 2-109353

[51] Int. Cl.[5] ..... D05B 19/00; D05B 47/04

[52] U.S. Cl. ..... 112/121.11; 112/162; 112/302; 112/199; 112/255

[58] Field of Search ..... 112/97, 121.11, 121.12, 112/162, 165, 166, 254, 255, 269.1, 278, 302, 445, 454, 456, 199, 262.11; 364/470

[56] References Cited

U.S. PATENT DOCUMENTS

| | | | |
|---|---|---|---|
| 4,178,864 | 12/1979 | Marcandalli | 112/159 |
| 4,200,048 | 4/1980 | Makabe et al. | 112/454 |
| 4,408,554 | 10/1983 | Takiguchi et al. | 112/302 |
| 4,499,836 | 2/1985 | Meier et al. | 112/454 X |
| 4,566,396 | 1/1986 | Sakuma et al. | 112/302 |
| 4,577,574 | 3/1986 | Takahashi | 112/445 |
| 4,590,879 | 5/1986 | Matsubara et al. | 112/278 |
| 4,649,844 | 3/1987 | Matsubara | 112/302 |
| 4,766,827 | 8/1988 | Matsubara | 112/278 |
| 4,777,896 | 10/1988 | Nomura | 112/121.11 X |
| 4,869,186 | 9/1989 | Ogawa | 112/255 |
| 5,010,834 | 4/1991 | Iimuro et al. | 112/302 |
| 5,056,446 | 10/1991 | Nakano et al. | 112/302 |
| 5,138,961 | 8/1992 | Nakano et al. | 112/302 X |

FOREIGN PATENT DOCUMENTS

| | | | |
|---|---|---|---|
| 61-40437 | 9/1986 | Japan | 112/454 |
| 2-063493 | 3/1990 | Japan | 112/302 |

*Primary Examiner*—Clifford D. Crowder
*Assistant Examiner*—Paul C. Lewis
*Attorney, Agent, or Firm*—Wegner, Cantor, Mueller & Player

[57] ABSTRACT

A sewing apparatus displays a stitch pattern and forcibly supplies a thread based on the displayed stitch pattern. The apparatus comprises a sewing mechanism, an automatic thread supply device, a key input unit, a memory, a selector and a display. The sewing mechanism has a sewing section which includes a needle and a looper driven in accordance with a rotation of a main shaft. The automatic thread supply device forcibly carries a needle thread and a looper thread to the sewing section. The key input unit sets lengths per stitch of the needle thread and the looper thread which are to be supplied by the automatic thread supply device to the sewing section. The memory stores a plurality of stitch patterns in correspondence with combinations of the lengths of the threads to be supplied per stitch. The selector selects one of the stitch patterns corresponding to the combination set by the key input unit. The display displays in graphics the stitch pattern selected by the selector.

12 Claims, 14 Drawing Sheets

SEWING APPARATUS EQUIPPED WITH AN AUTOMATIC THREAD SUPPLY DEVICE

BACKGROUND OF THE INVENTION (1) Field of the Invention

This invention relates to a sewing apparatus for displaying a stitch pattern and forcibly supplying a thread based on the displayed stitch pattern.

(2) Description of the Prior Art

An automatic thread supply device used, for example, in an overlocking sewing apparatus automatically supplies a needle thread and upper and lower looper threads. Since different types of threads are required in different lengths to form a stitch, such a device is equipped with a plurality of thread holding devices. A period for which each thread holding device is releasing the thread must be adjusted by an operator.

Although there is a certain relationship between the required length for each thread and the pattern of stitch, it is extremely hard even for a skilled operator to determine how much of each thread is required to get a desired pattern of stitch. Therefore, many tries have to be made before the desired pattern of stitch is obtained, which drastically lowers the operating efficiency of the sewing apparatus.

SUMMARY OF THE INVENTION

Accordingly, this invention has an object of offering a novel sewing apparatus for solving the above problem.

In accordance with the features of the present invention, there is provided a sewing apparatus with a display for displaying a stitch pattern. A sewing mechanism has a sewing section which includes a needle and a looper driven in accordance with a rotation of a main shaft. An automatic thread supply device forcibly carries a needle thread and a looper thread to the sewing section. A key input unit sets lengths per stitch of the needle thread and the looper thread which are to be supplied by the automatic thread supply device to the sewing section. A memory stores a plurality of stitch patterns in correspondence with combinations of the lengths of the threads to be supplied per stitch. A selector selects one of the stitch patterns, the one corresponding to the combination set by the key input unit. The display displays in graphics the stitch pattern selected by the selector.

The automatic thread supply device may comprise a plurality of roller pairs for holding the needle thread and the looper thread, respectively; a motor for rotating the roller pairs to supply the threads at respective circumferential speeds of the rollers; and a needle thread holding unit and a looper thread holding unit, each releasing the thread for a specified period of time per stitch, the units being provided upstream from the roller pairs in a thread supplying direction.

The motor may drive each roller pair at such a speed that the roller pair supplies the thread in a required length per stitch when the main shaft of the sewing mechanism is rotated at a maximum speed.

The automatic thread supply device may further comprise a rotation sensor provided on the main shaft of the sewing mechanism and a pulse encoder provided on the motor. In such a case, the thread holding units are each controlled to start releasing the thread when the rotation sensor detects that the main shaft is rotated a specified angle and to hold the thread when a pulse number detected by the pulse encoder reaches a specified value, the pulse number having been detected since the thread holding unit starts releasing the thread.

The memory may store a stitch number indicating each stitch pattern, a graphic image of each stitch pattern, and standard pulse numbers of the needle thread and the looper thread required to form a stitch of each stitch pattern; the stitch number, the graphic image and the standard pulse numbers being associated to one another.

The sewing apparatus may further comprise another looper thread holding unit. In such a case, the display comprises a first area for displaying the stitch pattern in graphics, a second area for displaying the stitch number, a third area for displaying a needle thread pulse number corresponding to a thread releasing period of the needle thread holding unit, a fourth area for displaying an upper looper thread pulse number corresponding to a thread releasing period of the upper looper thread holding unit, and a fifth area for displaying a lower looper thread pulse number corresponding to a thread releasing period of the lower looper thread holding unit.

The key input unit may comprise a stitch number changing key for selectively increasing and decreasing the stitch number displayed in the second area, a cursor moving key for selectively moving a cursor to the third, fourth and fifth areas, and a pulse number changing key for selectively increasing and decreasing the pulse number of the thread corresponding to the area where the cursor is located.

The sewing apparatus may further comprise a saving key for saving a combination of the pulse numbers displayed in the third through the fifth areas; and an executing key for starting to drive the sewing apparatus.

The selector may comprise a key operation judging section for judging if the saving key is on after the operation of the pulse number changing key; a comparing section for comparing the saved thread pulse numbers with thread pulse numbers stored in the memory; and an obtaining section for obtaining a stitch number based on the comparison result.

The selector may further comprise a functioning section. When the stitch number changing key is operated, the functioning section reads out the standard thread pulse numbers of the stitch number inputted by the stitch number changing key, irrespective of if the pulse changing key, the cursor moving key, and the saving key have been operated.

The sewing apparatus may further comprise a detecting device for detecting a leading end and a rear end of the cloth in the vicinity of the needle; an input prohibiting section for prohibiting the operation of the stitch number changing key, the cursor moving key, the pulse number changing key and the saving key after the executing key is operated; and a control section. When there is the cloth at a needle drop point while the sewing mechanism is driven, the control section controls the thread releasing periods per stitch of the thread holding units based on the pulse numbers displayed in the third through the fifth areas.

Also in accordance with the features of the present invention, a sewing mechanism has a sewing section which includes a needle and a looper driven in accordance with a rotation of a main shaft. A thread supply device supplies threads to the sewing section in lengths per stitch using thread pulse numbers which correspond to a rotating speed of a rotating shaft of the thread supply device. A key input unit sets the thread pulse numbers which determine a length of each thread per stitch. A memory stores a plurality of stitch patterns in correspondence with a combination of the thread pulse numbers. A selector selects one of the stitch patterns, the one corresponding to the combination of the thread pulse numbers set by the key input unit. A display displays in graphics the stitch pattern selected by the selector. A control section drives the main shaft and operates the thread supply device while a driving pedal is operated.

In the above construction, when an operator inputs lengths of different types of threads to be supplied per stitch, a stitch pattern which corresponds to the combination of the inputted lengths is selected and displayed in graphics. The operator gets a clear picture of what pattern of stitch will actually be obtained in advance by the graphic display. If the displayed stitch pattern is different from the desirable one, the operator can input again different lengths of the threads. In this way, the operator can make sure the desirable stitch will be realized without actually sewing the cloth.

BRIEF DESCRIPTION OF THE DRAWINGS

These and other objects, advantages and features of the invention will become apparent from the following description thereof taken in conjunction with the accompanying drawings which illustrate a specific embodiment of the invention. In the drawings.

DESCRIPTION OF THE PREFERRED EMBODIMENTS

Figure 1:
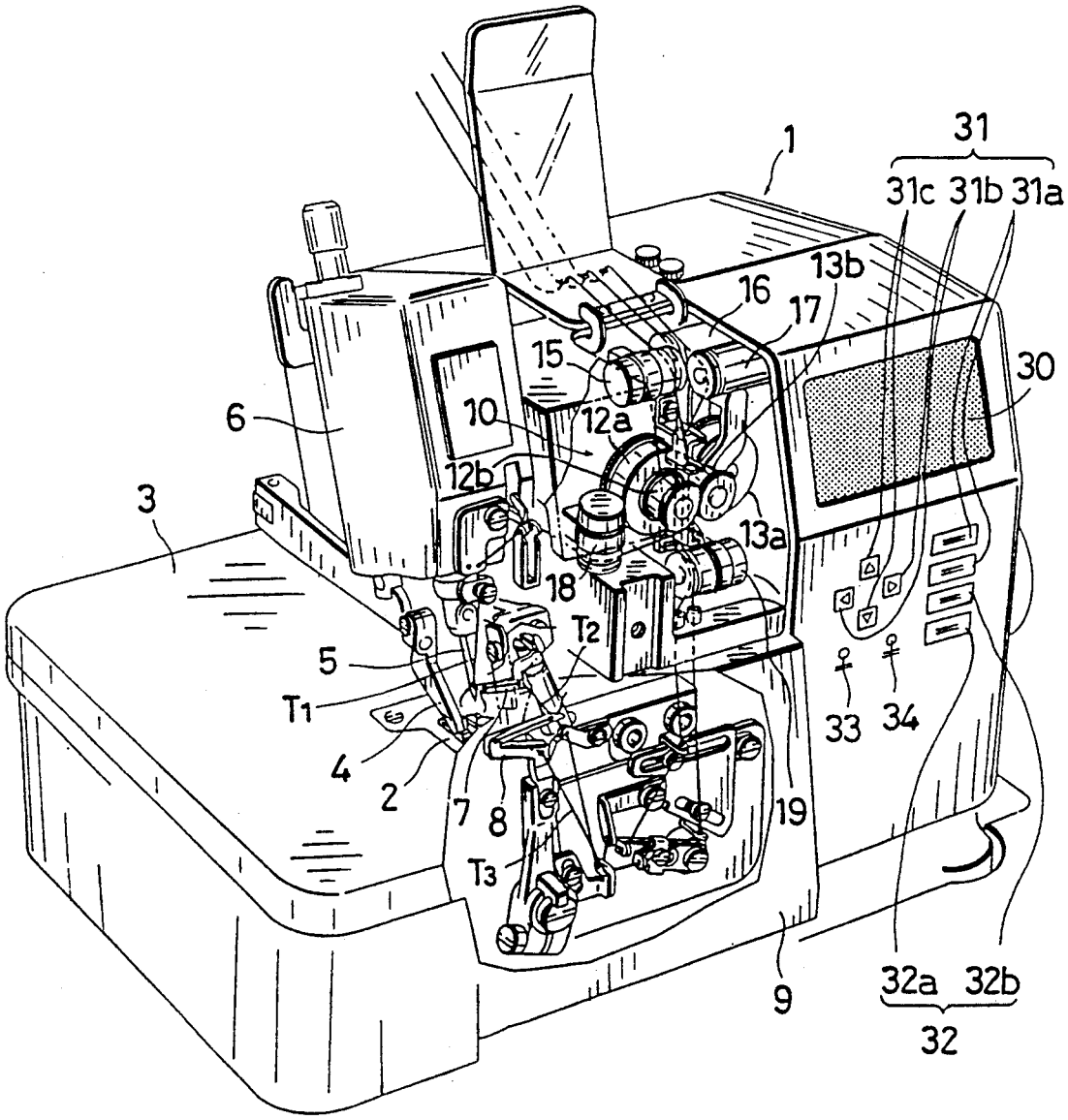
FIG. 1 is a perspective view of an overlocking sewing apparatus equipped with an automatic thread supply device according to this invention.

As shown in FIG. 1, a sewing apparatus 1 includes a well-known overlocking sewing mechanism driven in accordance with a rotation of a main shaft (not shown). The overlocking sewing mechanism comprises a sewing section including a transporting section 2 for retaining a cloth as a sewing medium and transporting the cloth at a specified pitch; a cloth table 3 on which the cloth is placed; a pressing member 4 for pressing the cloth placed on the table 3 by a specified force. The sewing section comprises a needle 5 driven by a well-known needle drive mechanism in an arm 6, an upper looper 7 and a lower looper 8, each looper of which is driven by a well-known looper drive mechanism. Each mechanism is driven in accordance with the rotation of the main shaft. The sewing apparatus 1 further comprises an automatic thread supply device 10 for supplying a needle thread T1, an upper looper thread T2 and a lower looper thread T3 and also for adjusting the length of each thread required for a stitch; and a frame 9 having the table 3, the arm 6, the device 10 at optimal positions and accommodating various mechanisms.

The automatic thread supply device 10 comprises a pair of large and small driving rollers 12*a* and 12*b* to be rotated at specified speeds, a pair of large and small subordinate rollers 13*a* and 13*b* respectively engaged with the driving rollers 12*a* and 12*b*, and five thread holding solenoids 15, 16, 17, 18 and 19. The solenoids 15 through 17 are provided upstream and the solenoids 18 and 19 are provided downstream from the above rollers in a thread supply direction.

The thread holding solenoids 15, 16 and 17 are to respectively hold the threads T1, T2 and T3, whereby preventing the running of the threads for the purpose of thread length adjustment. The solenoids 15, 16 and 17 are controlled to hold the threads for certain periods corresponding to pulse numbers displayed in display areas 30*b*, 30*c* and 30*d* (will be described later in detail).

The thread holding solenoid 18 is to hold the thread T1, and the thread holding solenoid 19 is to hold the threads T2 and T3, both whereby preventing the threads from being pulled down extra by the needle 5 and the upper and lower loopers 7 and 8.

The thread T1 which has passed by the solenoid 18 is carried to the needle 5, and the threads T2 and T3 which have passed by the solenoid 19 are carried to the upper and the lower loopers 7 and 8, all through the respective thread guiding holes. In accordance with the rotation of the main shaft, the needle 5, and the upper and the lower loopers 7 and 8 each makes a specified locus, based on which the cloth on the table 3 is sewn with the threads T1, T2 and T3.

Figure 2:
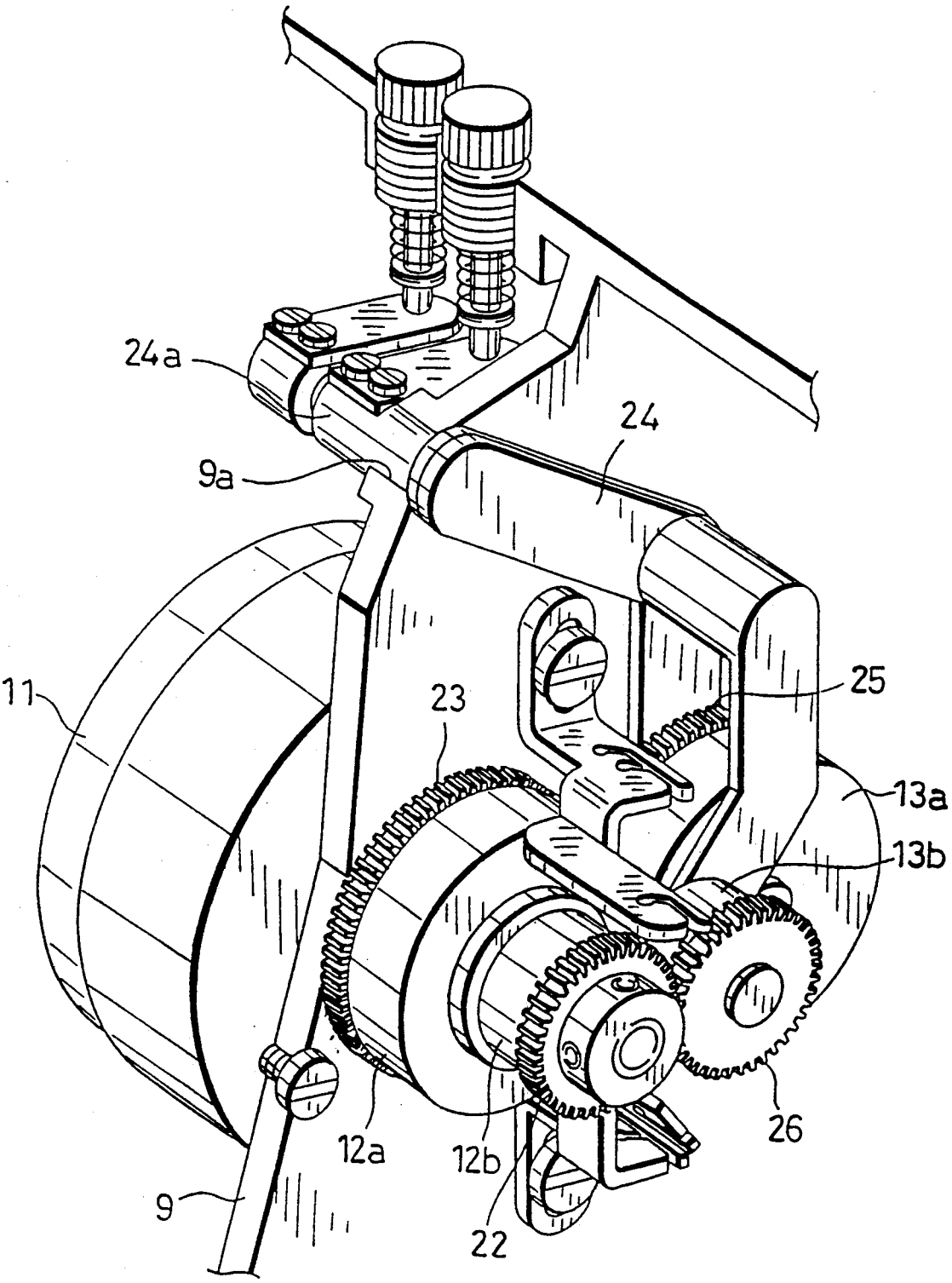
FIG. 2 is a perspective view of an essential part of the automatic thread supply device.

As shown in FIG. 2, the frame 9 has a motor 11 therein for driving the driving rollers 12*a* and 12*b*. The motor 11 is continuously rotated at a specified speed independent from the rotation of the main shaft. The rotating speed, which is set so that, for instance, the threads are supplied in required lengths when the main shaft is rotated at a maximum speed, is to be detected by a pulse encoder 50 (FIG. 4) which is attached to a rotating shaft (not shown) of the motor 11.

The motor 11 has an end portion of the rotating shaft projected outside the frame 9. Coaxially provided on the end portion are the driving roller 12, a large gear 23 and a small gear 22. The large gear 23 is attached on the large roller 12*a*, and the small gear is attached on the small roller 12*b*.

Above the rotating shaft, a pair of supporting arms 24 are swingably supported by the frame 9 through a shaft 24*a*, which is projected from one end of the arms 24 and also engaged in a hole 9*a* of the frame 9. The other ends of the supporting arms 24 are respectively attached to the subordinate rollers 13*a* and 13*b*. The large roller 13*a* has a large gear 25 attached thereon, and the small roller 13*b* has a small gear 26 attached thereon. The gears 23 and 25 are engaged with each other, and the gears 22 and 26 are engaged with each other. Running between the large rollers 12*a* and 13*a* are the upper and the lower looper threads T2 and T3, which are required in large lengths for each stitch. Running between the small rollers 12*b* and 13*b* is the needle thread T1, which is required in a small length for each stitch. The threads T1, T2 and T3 are to be carried down when the rollers 13*a* and 13*b* are driven by the motor 11.

Referring again to FIG. 1, the sewing apparatus 1 further comprises an LCD display 30 disposed at a front right part of the frame 9, a input key group 31, a function key group 32 and a control section 35 (FIG. 4) built in the frame 9.

Although not shown in FIG. 1, a cloth sensor 38 for optically detecting the cloth is provided in the vicinity of a needle drop point and a rotation sensor 37 for detecting a rotation of the main shaft is provided on the main shaft.

Figure 3:
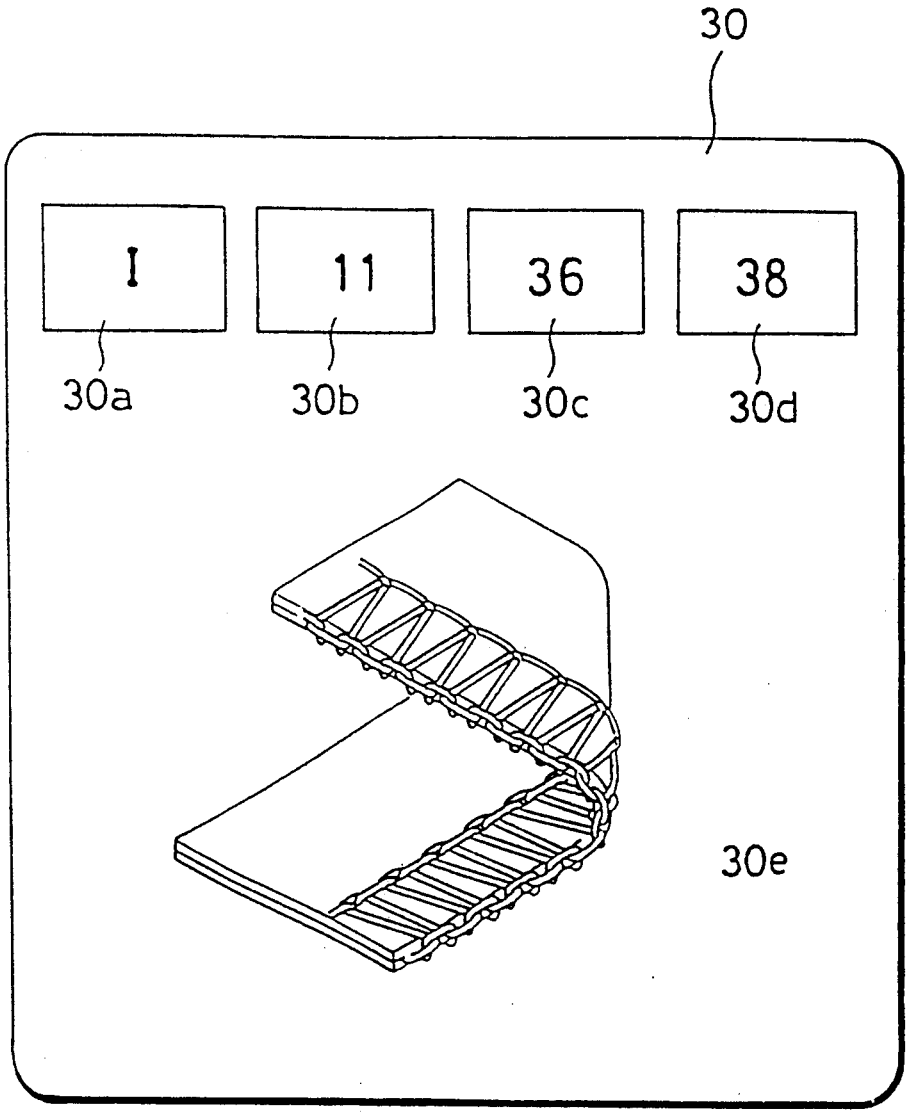
FIG. 3 is an enlarged view of an LCD display.

As shown in FIG. 3, the LCD display 30 comprises a stitch number display area 30*a* for displaying a stitch number, a needle thread pulse number display area 30*b* for displaying a needle thread pulse number, an upper looper thread pulse number display area 30*c* for displaying an upper looper thread pulse number, and a lower looper thread pulse number display area 30*d* for displaying a lower looper thread pulse number. The above four display areas are arranged in a horizontal line. The LCD display 30 further comprises a graphic display area 30*e* for displaying a stitch pattern in graphics, the area 30*e* occupying a wide area below the above four areas 30*a* through 30*d*.

The input key group 31 comprises a pair of stitch number increase/decrease keys 31*a* respectively for increasing and decreasing the stitch number displayed in the area 30*a*, a pair of cursor moving keys 31*b* for moving a cursor located in the area 30*b*, 30*c* or 30*d* to a desired area, and a pair of thread pulse number increase/decrease keys 31*c* respectively for increasing and decreasing the thread pulse number of the area where the cursor is located. The keys 31*b* and 31*c* are arranged in a cross.

The function key group 32 comprises a saving key 32*a* for saving a combination of the thread pulse numbers displayed in the areas 30*b*, 30*c* and 30*d*; and an execution key 32*b* for starting the operation of the sewing apparatus 1. Arranged below the keys 31*b* and 31*c* are a cloth lamp 33 for indicating if the cloth is set on the table 3 and a driving lamp 34 for indicating if the sewing apparatus 1 is driven.

Figure 4:
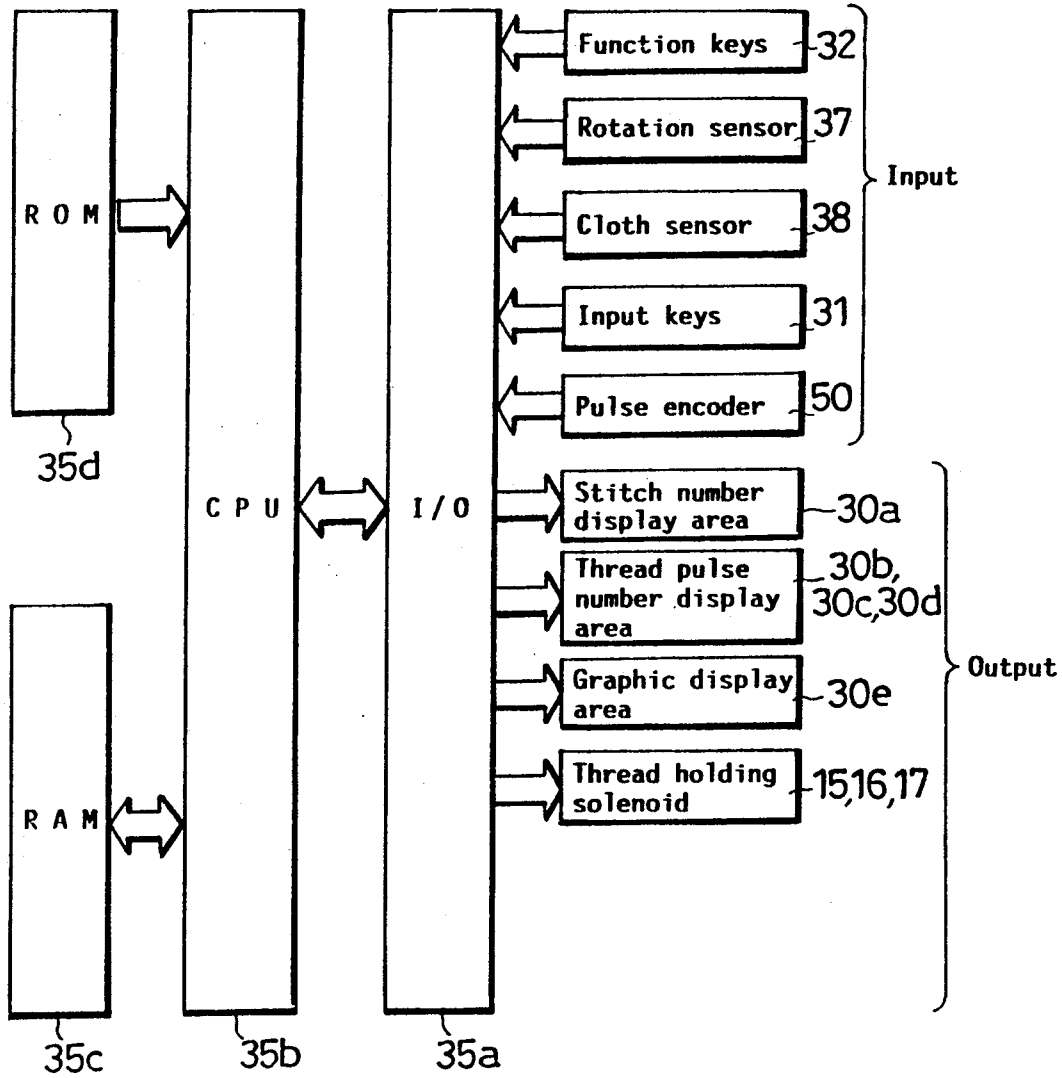
FIG. 4 is a circuit diagram of a control section.

As shown in FIG. 4, the control section 35 comprises an I/O interface 35*a*, a CPU 35*b*, a RAM 35*c* and a ROM 35*d*.

Inputted to the I/O interface 35*a* are data from the function key group 32 and the input key group 31, and signals from the sensors 37 and 38 and the pulse encoder 50. Operation results of the CPU 35*b* are outputted from the I/O interface 35*a* to the areas 30*a* through 30*e* and the solenoids 15 through 17.

As well as executing the total control of the sewing apparatus 1, the CPU 35*b* selects a stitch pattern based on the data inputted by the above keys from a plurality of patterns stored in the RAM 35*c* or the ROM 35*d*.

The selection of the stitch pattern is carried out in two different methods using Tables 1 and 2 stored in the RAM 35*c* or the ROM 35*d*.

[Method 1] Desirable needle, upper looper and lower looper thread pulse numbers are inputted by the keys 31*c* and then saved by the saving key 32*a*. The combination of the above three pulse numbers is compared with the contents of Table 1. The stitch number which corresponds to all the three pulse numbers is selected. Then, the stitch pattern indicated by the selected stitch number is obtained and displayed in the area 30*e*.

[Method 2] A desirable stitch number is inputted by the keys 31*a*. The stitch number is compared with the contents of Table 2, and standard pulse numbers corresponding to the stitch number are obtained.

Figure 8A:
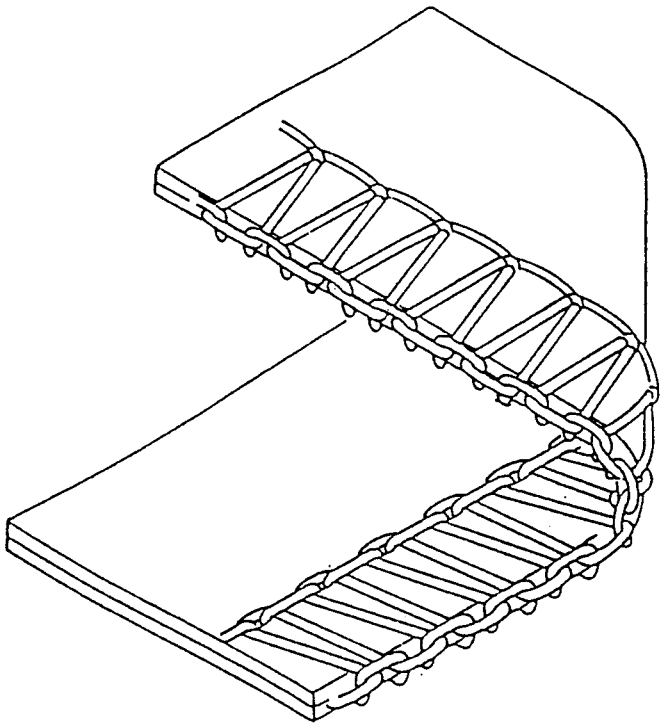
FIGS. 8*a* through 8*o* are views of stitch patterns.
Figure 8B:
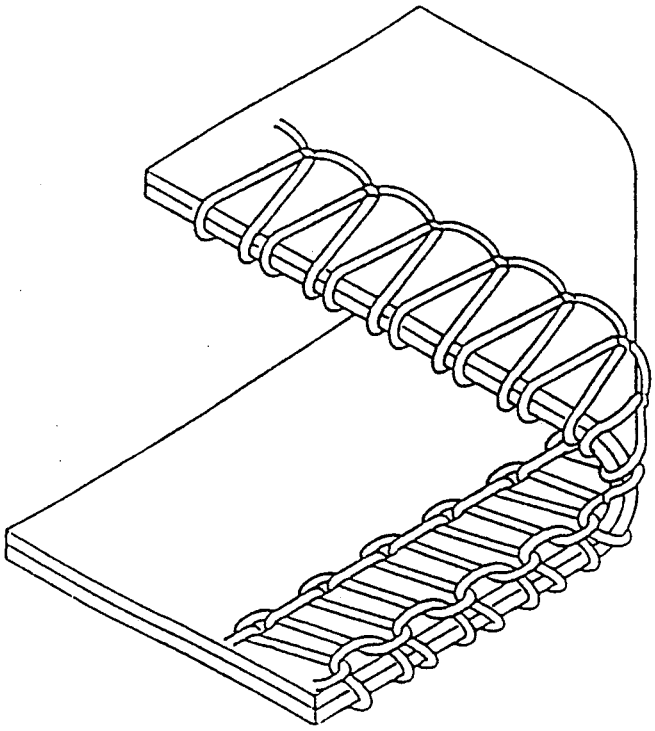
Figure 8C:
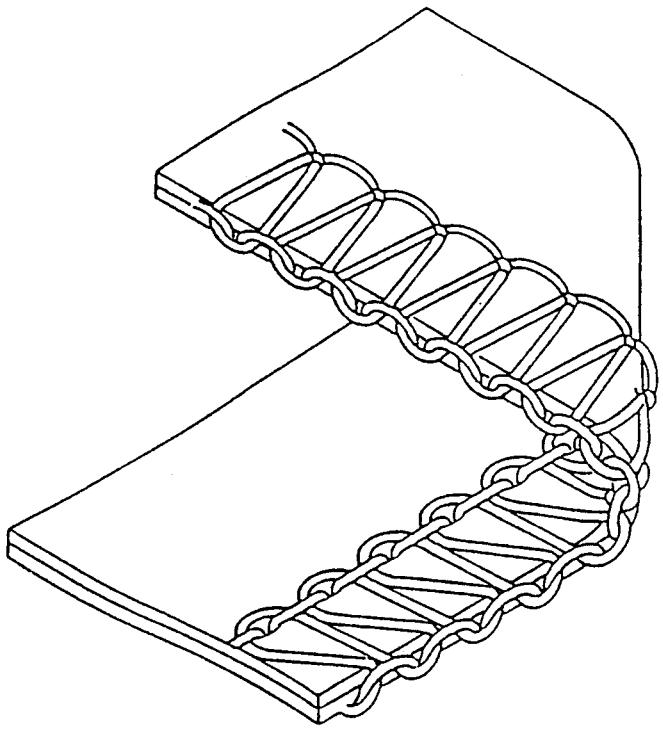
Figure 8D:
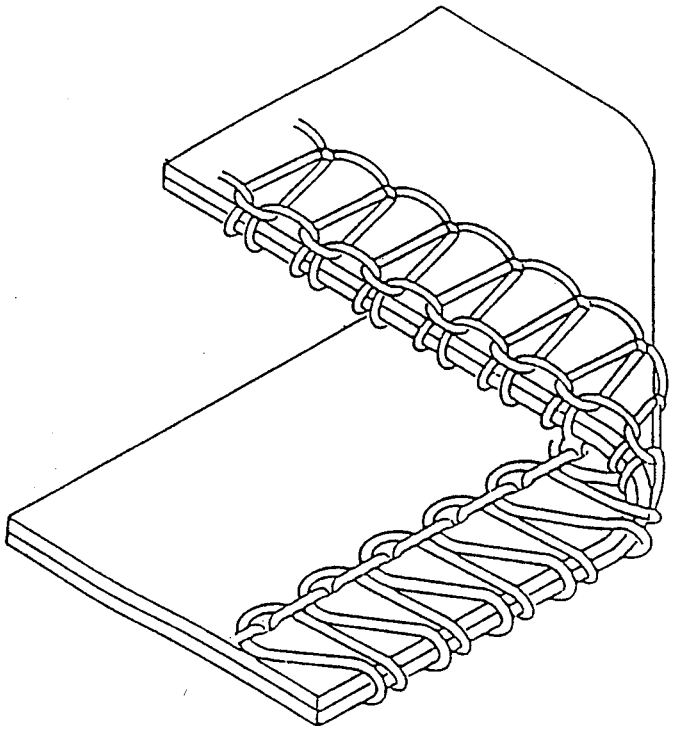
Figure 8E:
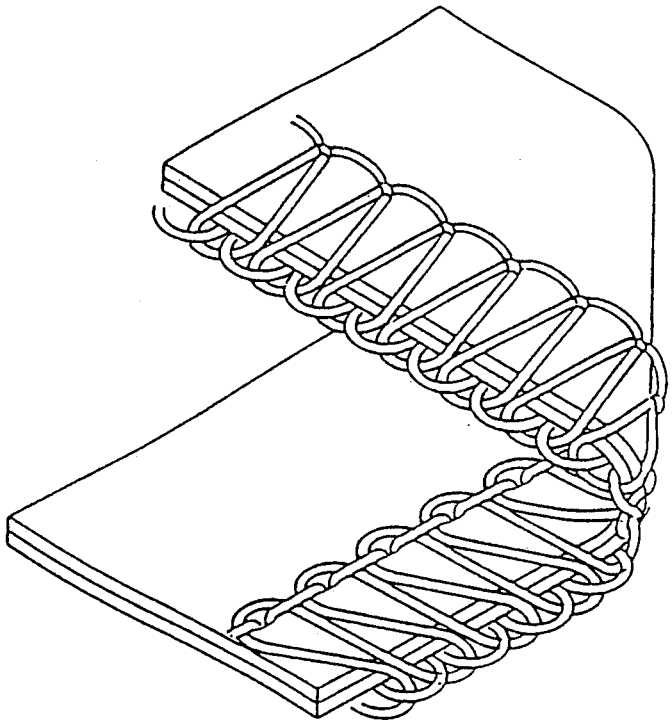
Figure 8F:
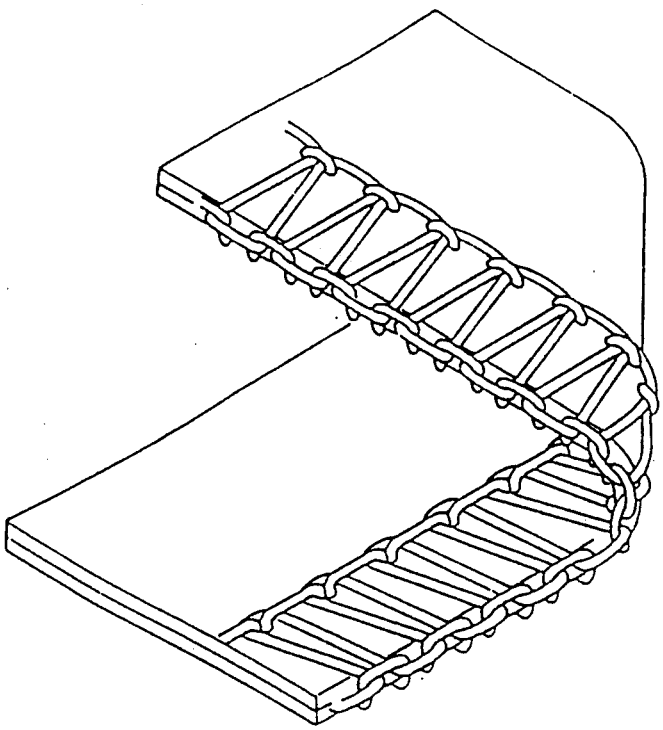
Figure 8G:
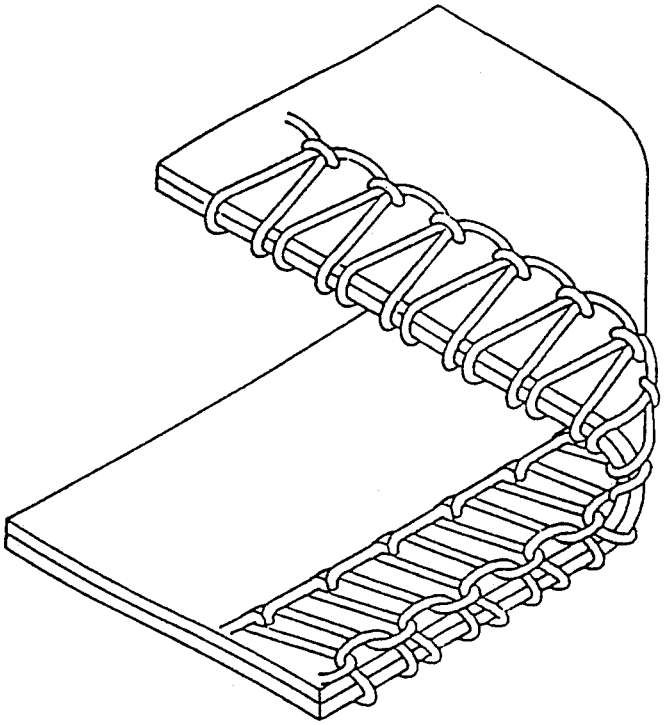
Figure 8H:
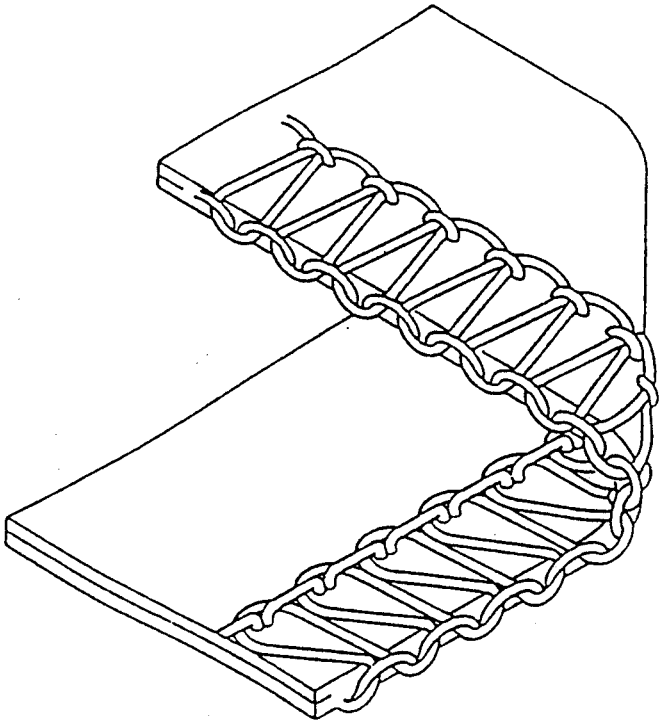
Figure 8I:
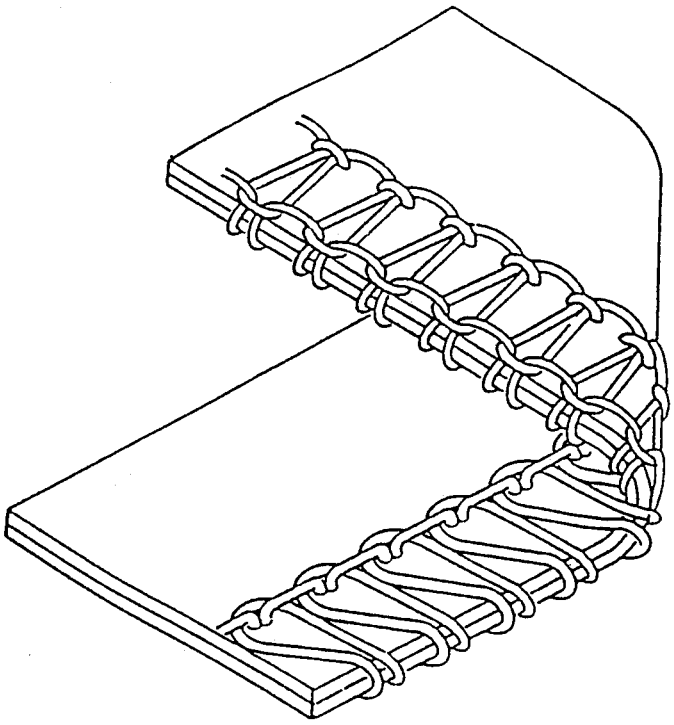
Figure 8J:
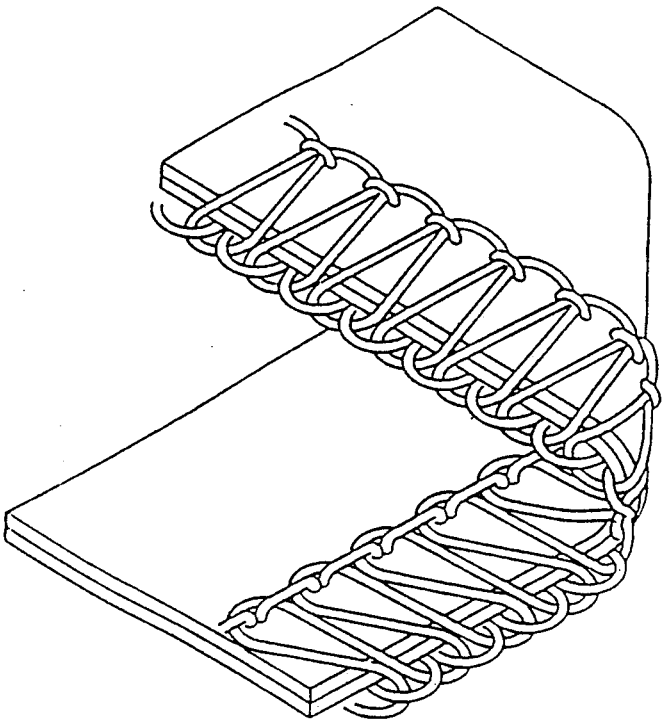
Figure 8K:
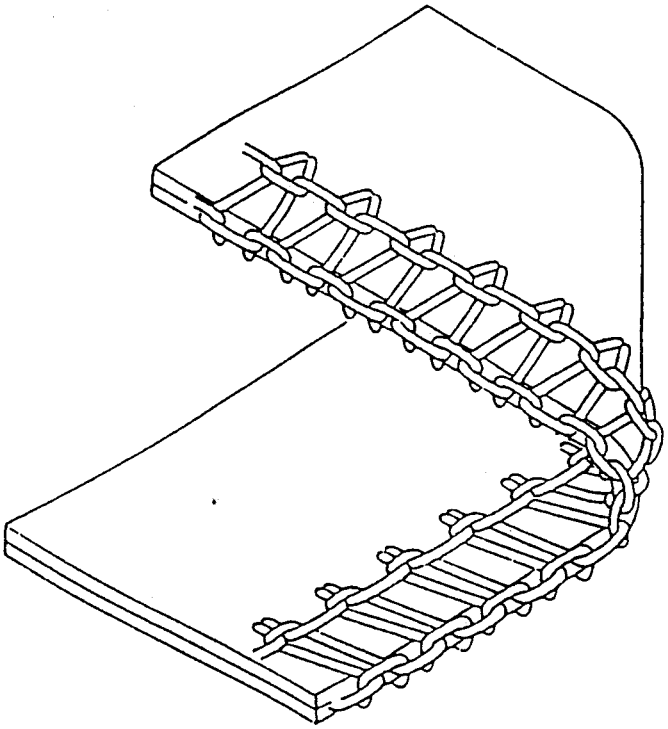
Figure 8L:
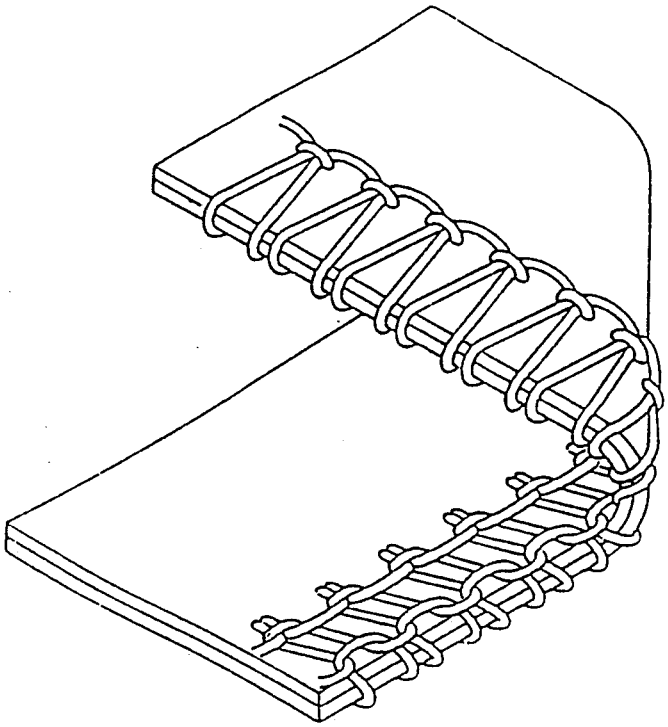
Figure 8M:
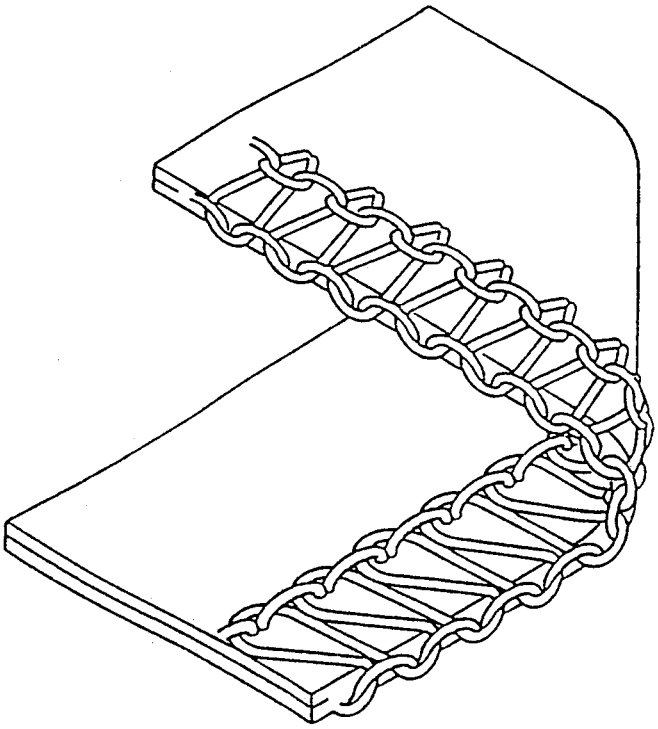
Figure 8N:
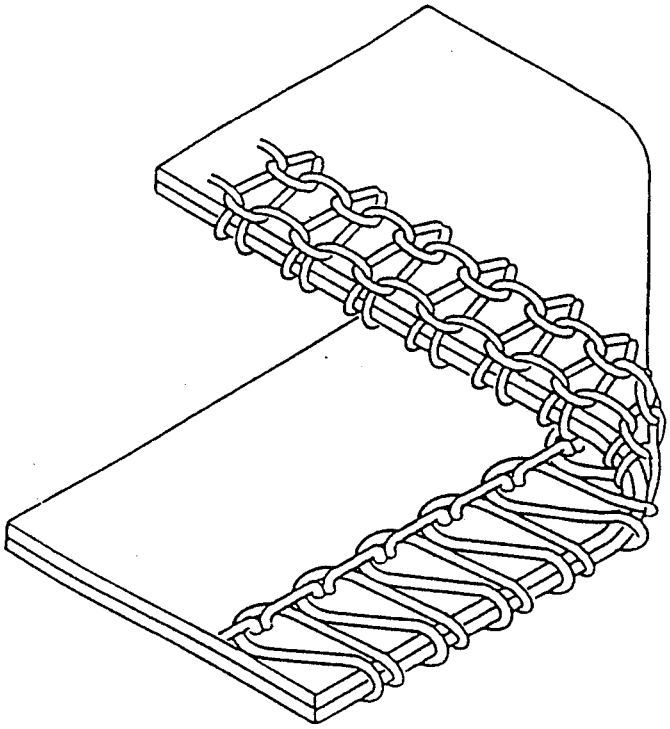
Figure 8O:
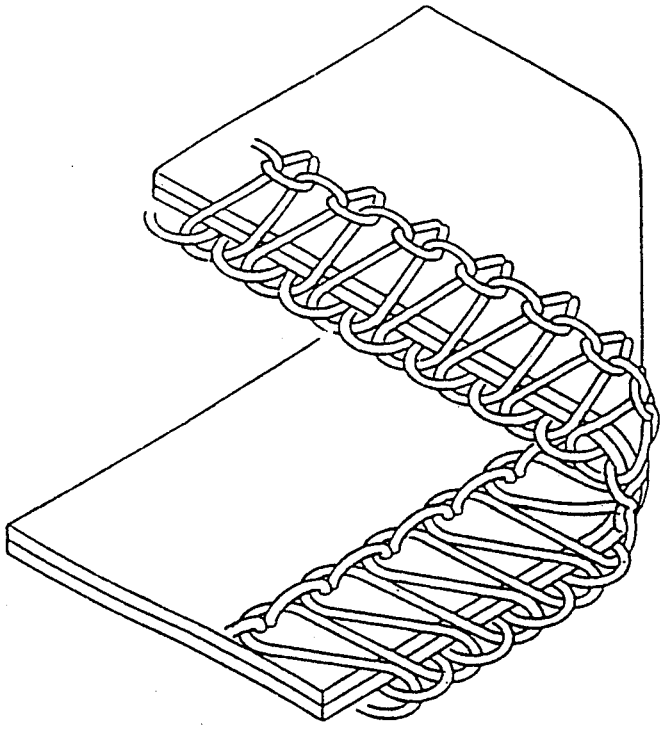

The RAM 35*c* or the ROM 35*d* also images corresponding to fifteen stitch patterns I through XV shown in FIGS. 8*a* through 8*o*.

TABLE 1

| Needle thread pulse | Upper looper thread pulse | Lower looper thread pulse 35–40 | 41–44 | 45–50 |
|---|---|---|---|---|
| 10–13 | 35–40 | I | II | II |
| | 41–44 | IV | III | II |
| | 45–50 | IV | IV | V |
| 14–17 | 35–40 | VI | VII | VII |
| | 41–44 | IX | VIII | VII |
| | 45–50 | IX | IX | X |
| 18–22 | 35–40 | XI | XII | XII |
| | 41–44 | XIV | XIII | XII |
| | 45–50 | xIV | XIV | XV |

TABLE 2

| Stitch No. | Needle thread pulse | Upper looper pulse | Lower looper pulse |
|---|---|---|---|
| I | 10 | 35 | 35 |
| II | 10 | 35 | 41 |
| III | 10 | 41 | 41 |
| IV | 10 | 41 | 35 |
| V | 10 | 45 | 45 |
| VI | 14 | 35 | 35 |
| VII | 14 | 35 | 41 |
| VIII | 14 | 41 | 41 |
| IX | 14 | 41 | 35 |
| X | 14 | 45 | 45 |
| XI | 18 | 35 | 35 |
| XII | 18 | 35 | 41 |
| XIII | 18 | 41 | 41 |
| XIV | 18 | 41 | 35 |
| XV | 18 | 45 | 45 |

In the overlocking sewing apparatus 1, the key input and driving operation is executed in the following way.

Figure 5:
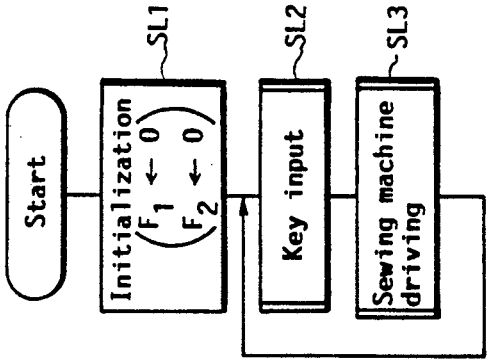
FIG. 5 is a flowchart of a main routine.

A main routine is shown in FIG. 5. Flags $F_1$ and $F_2$ are reset as initialization (SL1). Then, a subroutine of key input (SL2) and a subroutine of driving the sewing apparatus 1 (SL3) are repeated in this order.

Figure 6:
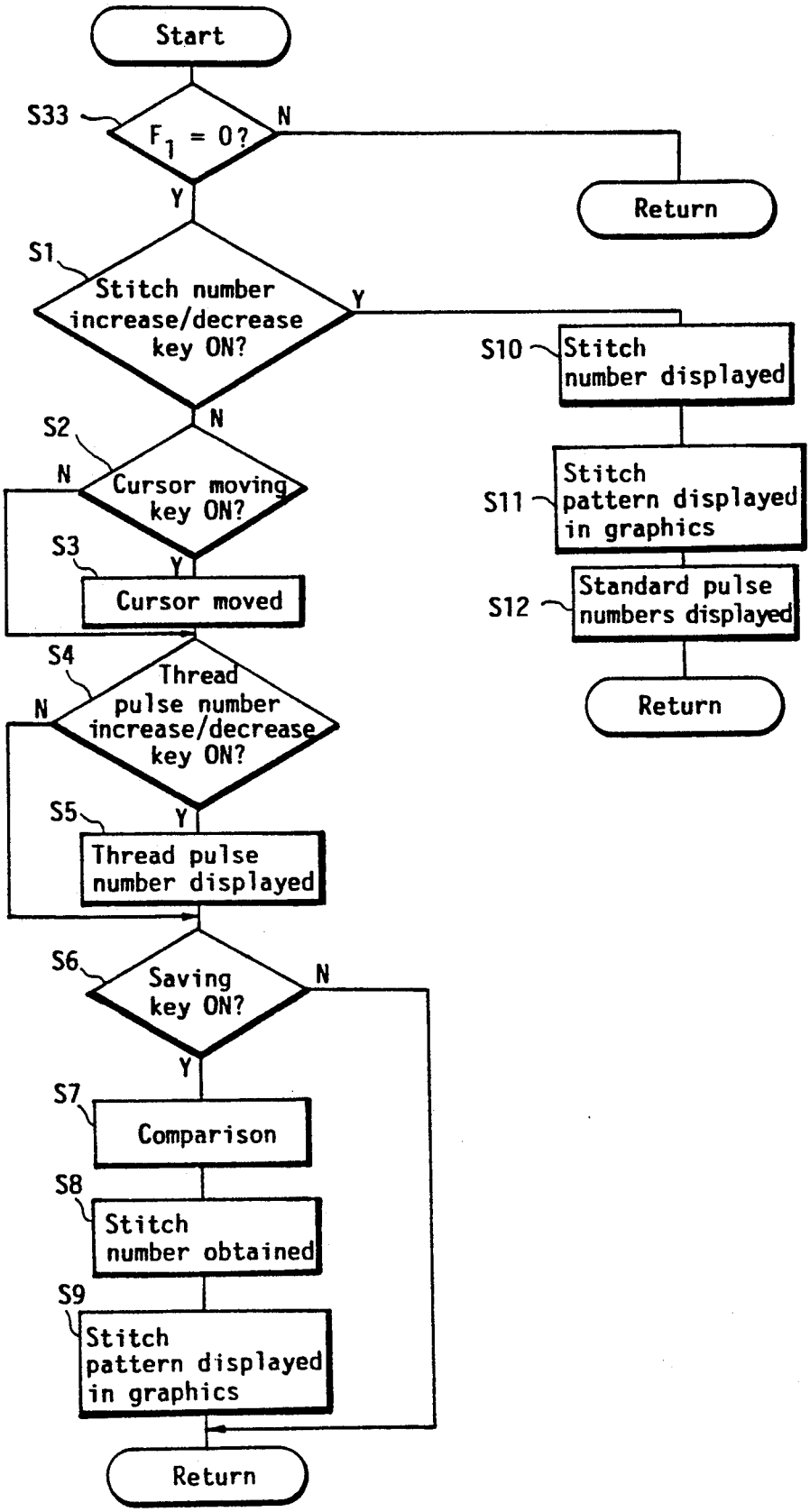
FIG. 6 is a flowchart of a subroutine of key input.

The subroutine of the key input is executed as shown in FIG. 6. First, whether the flag $F_1$ is reset ($F_1=0$) or not is judged (S33). If the flag $F_1$ is set ($F_1=1$), it means the execution key 32*b* is on and therefore, the operation of the input key group 31 is prohibited while the sewing apparatus 1 is driven. If the key 32*b* is reset, the operation goes to S1, where whether either one of the stitch number increase/decrease keys 31*a* is on is judged. If none of the keys 31*a* is on, whether either one of the cursor moving keys 31*b* is on is judged (S2). If either one of the keys 31*a* is on, the cursor is moved as commanded (S3). If none of the keys 31*b* is on, the operation goes to S4. In S4, whether either one of the pulse number increase/decrease keys 31*c* is on is judged. If either one of the keys 31*c* is on, the thread pulse number displayed in the area 30*b*, 30*c* or 30*d* is increased or decreased as commanded (S5). If none of the keys 31*c* is on, the operation goes to S6.

In S6, whether the saving key 32*a* is on or not is judged. If the key 32*a* is not on, the operation returns to the main routine. If the key 32*a* is on, the thread pulse numbers displayed in the areas 30*b*, 30*c* and 30*d* are saved, the combination of the saved thread pulse numbers is compared with the contents of Table 1 (S7), and the stitch number which corresponds to the combination is obtained (S8). For example, if the needle thread pulse number displayed in the area 30*b* is "11", the upper looper thread pulse number in the area 30*c* is "36", and the lower looper thread pulse number in the area 30*d* is "38", the stitch number I is obtained. Then, the stitch pattern indicated by the stitch number I is selected and displayed in the area 30e in graphics (S9). Then, the operation returns to the main routine.

If either one of the keys 31a is on in S1, the stitch number displayed in the area 30a is increased or decreased as commanded (S10). The stitch pattern corresponding to the stitch number selected in S10 is displayed in the area 30e (S11), and the standard thread pulse numbers corresponding to the stitch number are obtained from Table 2 and are displayed in the areas 30b, 30c and 30d (S12). For example, if the stitch number III is selected, "10" is displayed in the area 30b, "41" in the area 30c, and "41" in the area 30d. Then, the operation returns to the main routine.

Figure 7:
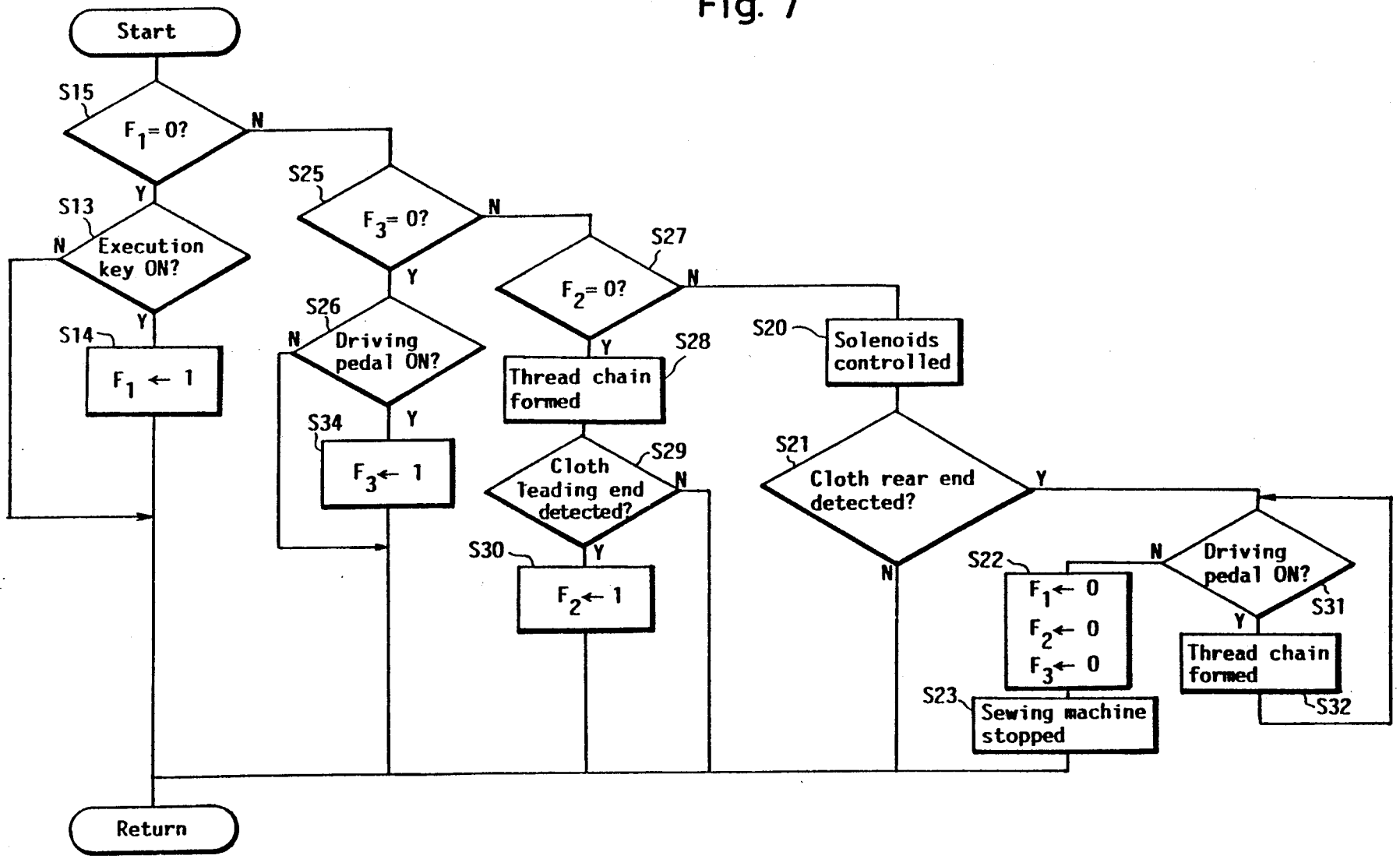
FIG. 7 is a flowchart of a subroutine of driving the sewing apparatus.

The subroutine of driving the sewing apparatus 1 is executed as shown in FIG. 7. First, whether a flag $F_1$ is reset or not is judged (S15). Since $F_1=0$ after the initialization, the operation goes to S13, where whether the execution key 32b is on or not is judged. If not, the operation returns to the main routine for another key input. If the key 32b is on, the operation goes to S14, where the flag $F_1$ is set.

Once the flag $F_1$ is set, the operation goes to S25. Unless the flag $F_1$ is reset, the key input in FIG. 6 is prohibited. In S25, whether a flag $F_3$ is reset or not is judged. The flag $F_3=0$ unless a driving pedal of the sewing apparatus 1 is judged to be pushed in S26. The instance the driving pedal is pushed, the operation goes to S26 and then S34, where the flag $F_3$ is set. The flag $F_3$ is not reset unless the driving pedal is judged to be released in S31. Accordingly, once the flag $F_3$ is set, the operation goes from S15 to S25 and then to S27, where whether a flag $F_2$ is reset or not is judged. The flag $F_2$ is to be set when the cloth sensor 38 detects a leading end of the cloth.

If $F_2=0$ in S27, the operation goes to S28, where the automatic thread supply device 10 supplies the threads T1, T2 and T3 in lengths required for forming a thread chain, and the sewing apparatus 1 is driven to form thread chains. Data on how much of each thread is required for forming a thread chain is stored in the RAM 35c or 35d in advance.

Then, whether the leading end of the cloth is detected by the cloth sensor 38 or not is judged (S29). If not, the operation returns to the main routine. If the leading end is detected, the flag $F_2$ is set in S30.

Once the flag $F_2$ is set, the operation goes from S27 to S20.

In S20, the releasing periods of the solenoids 15, 16 and 17 per stitch are controlled by the thread pulse numbers displayed in the areas 30b, 30c and 30d, whereby the length of each thread to supply is adjusted and the cloth is sewn with the stitch pattern displayed in the area 30e.

The releasing periods of the solenoids 15, 16 and 17 are controlled by a rotating angle of the main shaft obtained by the rotation sensor 37 and pulses obtained by the pulse encoder 50 in the following way.

When the main shaft is rotated a specified angle per stitch, the solenoids 15, 16 and 17 are de-electrified to release the threads. Simultaneously, the pulses sent from the pulse encoder 50 is counted by the CPU 35. When the counted number reaches each of the thread pulse numbers displayed in the areas 30b, 30c and 30d, the solenoids 15, 16 and 17 are electrified to hold the threads. On the other hand, the driving rollers 12a and 12b and the subordinate rollers 13a and 13b are continuously driven by the motor 11. Accordingly, when the solenoids 15, 16 and 17 release the threads, the threads T1, T2 and T3 are respectively sent to the needle 5, the upper looper 7 and the lower looper 8. The thread T1 is sent at substantially the same speed as the circumferential speed of the roller 22, and the threads T2 and T3 are sent at the substantial the same speed as the circumferential speed of the roller 23. The supplied lengths per stitch of the threads are not influenced by the rotating speed of the main shaft since 1) the motor 11 is rotated at a speed independent from that of the main shaft and 2) the thread releasing periods of the solenoids 15, 16 and 17 are determined by the pulse number sent from the pulse encoder 50 provided on the rotating shaft of the motor 11. Such a uniformity of supplied lengths of the threads is ideal, considering that the length of the read required to form a stitch is not influenced by the rotating speed of the main shaft in an actual sewing operation.

The timing and periods of releasing the solenoids 15 through 17 are controlled in the same way while thread chains are formed although the periods are different.

If a rear end of the cloth is detected by the cloth sensor 38 (S21), the operation goes to S31, where whether the driving pedal is pushed or not is judged. As long as the driving pedal is being pushed, the sewing apparatus 1 is continuously driven, but the supplied length of each thread is changed to form thread chains. If the driving pedal is judged to be released in S31, the flags $F_1$, $F_2$ and $F_3$ are reset (S22) and the driving of the sewing apparatus 1 is stopped (S23). Then, the operation returns to the main routine.

As has been described so far, all the operator has to do is to input the length of each thread to supply in the form of the pulse number. The stitch pattern corresponding to the combination of the inputted pulse numbers is automatically selected and displayed in graphics. Accordingly, the operator gets a clear picture in advance of what stitch pattern will be obtained. If the displayed pattern is different from the desired one, different pulse numbers can be inputted before the cloth is actually sewn. In this way, a desired stitch pattern can be obtained easily. If the fifteen patterns available are numbered, the operator only has to input the desired number.

Needless to say, the available stitch patterns are not limited to fifteen.

Although the present invention has been fully described by way of an embodiment with references to the accompanying drawings, it is to be noted that various changes and modifications will be apparent to those skilled in the art. Therefore, unless such changes and modifications depart from the scope of the present invention, they should be construed as being included therein.

What is claimed is:

1. A sewing apparatus comprising:

a sewing mechanism having a sewing section including a needle and a looper driven in accordance with a rotation of a main shaft;

an automatic thread supply device for forcibly carrying a needle thread and at least one looper thread to the sewing section;

key input means for setting lengths per stitch of the needle thread and the at least one looper thread which are to be supplied by said automatic thread supply device to the sewing section;

memory means for storing a plurality of stitch patterns in correspondence with combinations of the lengths of the threads to be supplied per stitch;

selecting means for selecting one of the stitch patterns corresponding to the combinations of the lengths of the threads set by said key input means; and display means for displaying in graphics the stitch pattern selected by said selecting means, wherein said display means displays the selected stitch pattern corresponding to the combination of the lengths of threads which said automatic thread supply device supplies to said sewing section.

2. A sewing apparatus of claim 1, wherein the automatic thread supply device comprises:

a plurality of roller pairs for holding the needle thread and the at least one looper thread, respectively;

a motor for rotating the roller pairs to supply the threads at respective circumferential speeds of the rollers; and a needle thread holding device and a first looper thread holding device, each releasing the thread for a specified period of time per stitch, the devices being provided upstream from the roller pairs in a thread supplying direction.

3. A sewing apparatus of claim 2, wherein the motor drives each roller pair at such a speed that the roller pair supplies the thread in a required length per stitch when the main shaft of the sewing mechanism is rotated at a maximum speed.

4. A sewing apparatus of claim 3, wherein the automatic thread supply device further comprises a rotation sensor provided on the main shaft of the sewing mechanism and a pulse encoder provided on said motor, wherein the thread holding devices are each controlled to start releasing the thread when the rotation sensor detects that the main shaft is rotated a specified angle and to hold the thread when a pulse number detected by the pulse encoder reaches a specified value, the pulse number having been detected since the thread holding devices started releasing the thread.

5. A sewing apparatus of claim 4, wherein said memory means stores a stitch number indicating each stitch pattern, a graphic image of each stitch pattern, and standard pulse numbers of the needle thread and the at least one looper thread required to form a stitch for each stitch pattern; the stitch number, the graphic image and the standard pulse numbers being associated with one another.

6. A sewing apparatus of claim 5, further comprising a second looper thread holding device, wherein said display means comprises a first area for displaying the stitch pattern in graphics, a second area for displaying the stitch number, a third area for displaying a needle thread pulse number corresponding to a thread releasing period of the needle thread holding device, a fourth area for displaying an upper looper thread pulse number corresponding to a thread releasing period of the first looper thread holding device, and a fifth area for displaying a lower looper thread pulse number corresponding to a thread releasing period of the second looper thread holding device.

7. A sewing apparatus of claim 6, wherein said key input means comprises a stitch number changing key for selectively increasing and decreasing the stitch number displayed in the second area, a cursor moving key for selectively moving a cursor to the third, fourth and fifth areas, and a pulse number changing key for selectively increasing and decreasing the pulse number of the thread corresponding to the area where the cursor is located.

8. A sewing apparatus of claim 7, further comprising:

a saving key for saving a combination of the pulse numbers displayed in the third through the fifth areas; and an executing key for starting to drive the sewing apparatus.

9. A sewing apparatus of claim 8, wherein said selecting means comprising:

a key operation judging section for judging if the saving key is on after the operation of the pulse number changing key;

a comparing section for comparing the saved thread pulse numbers with thread pulse numbers stored in said memory means; and an obtaining section for obtaining a stitch number based on an output signal from said comparing section.

10. A sewing apparatus of claim 9, wherein said selecting means further comprises:

a functioning section for, when the stitch number changing key is operated, reading out the standard thread pulse numbers of the stitch number inputted by the stitch number changing key, irrespective of if the pulse changing key, the cursor moving key, and the saving key have been operated.

11. A sewing apparatus of claim 10, further comprising:

detecting means for detecting a leading end and a rear end of the cloth in the vicinity of the needle;

input prohibiting means for, after the executing key is operated, prohibiting the operation of the stitch number changing key, the cursor moving key, the pulse number changing key and the saving key; and control means for, when there is the cloth at a needle drop point while the sewing mechanism is driven, controlling the thread releasing periods per stitch of the thread holding devices based on the pulse numbers displayed in the third through the fifth areas.

12. A sewing apparatus comprising:

a sewing mechanism having a sewing section including a needle and a looper driven in accordance with a rotation of a main shaft;

thread supply means for supplying a needle thread and at least one looper thread to the sewing section in lengths per stitch using thread pulse numbers corresponding to a rotating speed of a rotating shaft of the thread supply means;

key input means for setting the thread pulse number which determine a length of each thread per stitch;

memory means for storing a plurality of stitch patterns in correspondence with a combination of the thread pulse numbers;

selecting means for selecting one of the stitch patterns corresponding to the combination of the thread pulse numbers set by the key input means;

display means for displaying in graphics the stitch pattern selected by the selecting means, wherein said display means displays the selected stitch pattern corresponding to the combination of the thread pulse numbers for the lengths of the threads which said thread supply means supplies to said sewing section; and control means for driving the main shaft and operating the thread supply means while a driving pedal is operated.

* * * * *